US012467008B2

(12) United States Patent
Reid et al.

(10) Patent No.: US 12,467,008 B2
(45) **Date of Patent: *Nov. 11, 2025**

(54) METHODS AND USES RELATING TO FUEL COMPOSITIONS

(71) Applicant: INNOSPEC LIMITED, Port Cheshire (GB)

(72) Inventors: Jacqueline Reid, Port Cheshire (GB); Nigel John Broom, Port Cheshire (GB); Adele Cross, Port Cheshire (GB)

(73) Assignee: INNOSPEC LIMITED, Cheshire (GB)

( * ) Notice: Subject to any disclaimer, the term of this patent is extended or adjusted under 35 U.S.C. 154(b) by 0 days.

This patent is subject to a terminal disclaimer.

(21) Appl. No.: 18/718,255

(22) PCT Filed: Dec. 14, 2022

(86) PCT No.: PCT/GB2022/053216

§ 371 (c)(1),
(2) Date: Jun. 10, 2024

(87) PCT Pub. No.: WO2023/111550

PCT Pub. Date: Jun. 22, 2023

(65) Prior Publication Data

US 2025/0051672 A1 Feb. 13, 2025

(30) Foreign Application Priority Data

Dec. 14, 2021 (GB) ..... 2118100

(51) Int. Cl.
*C10L 10/04* (2006.01)
*C10L 1/222* (2006.01)
*C10L 10/06* (2006.01)

(52) U.S. Cl.
CPC ..... *C10L 10/04* (2013.01); *C10L 1/2222* (2013.01); *C10L 10/06* (2013.01); *C10L 2200/0423* (2013.01); *C10L 2270/023* (2013.01)

(58) Field of Classification Search
CPC ..... C10L 10/04; C10L 10/06; C10L 1/238; C10L 1/2222; C10L 2200/0423; C10L 2270/023
See application file for complete search history.

(56) References Cited

U.S. PATENT DOCUMENTS 2,488,612 A 11/1949 Tunick
3,172,892 A 3/1965 Le Suer et al.
3,219,666 A 11/1965 Norman et al.
3,272,746 A 9/1966 Le Suer et al.
3,275,554 A 9/1966 Wagenaar
3,310,402 A 3/1967 Jan et al.
3,310,492 A 3/1967 Benoit
3,341,542 A 9/1967 Le Suer et al.
3,438,757 A 4/1969 Honnen et al.
3,444,170 A 5/1969 Norman et al.
3,454,555 A 7/1969 Van Der Voort et al.
3,455,831 A 7/1969 Davis
3,455,832 A 7/1969 Davis
3,565,804 A 2/1971 Honnen et al.
3,576,743 A 4/1971 Widmer et al.
3,630,904 A 12/1971 Musser et al.
3,632,511 A 1/1972 Liao
3,755,433 A 8/1973 Miller et al.
3,804,763 A 4/1974 Meinhardt
3,822,209 A 7/1974 Knapp et al.
4,234,435 A 11/1980 Meinhardt et al.
4,288,612 A 9/1981 Lewis et al.
4,617,026 A 10/1986 Shaub et al.
4,877,416 A 10/1989 Campbell
5,089,029 A 2/1992 Hashimoto et al.
5,112,364 A 5/1992 Rath et al.
5,634,951 A 6/1997 Colucci et al.
5,725,612 A 3/1998 Malfer et al.
5,876,468 A 3/1999 Moreton
5,925,151 A 7/1999 Decanio et al.
6,217,624 B1 4/2001 Morris et al.
6,800,103 B2 10/2004 Malfer et al.
6,821,307 B2 11/2004 Caprotti et al.
6,866,690 B2 3/2005 Aradi et al.
7,291,758 B2 11/2007 Bohnenpoll et al.
7,988,749 B2 8/2011 Lange et al.

(Continued)

FOREIGN PATENT DOCUMENTS

EP 0244616 A2 11/1987
EP 0310875 A1 4/1989

(Continued)

OTHER PUBLICATIONS

International Search Report (ISR) issued for PCT/GB2022/053214, dated Mar. 24, 2023 (3 pages).

(Continued)

*Primary Examiner* — Vishal V Vasisth

(74) *Attorney, Agent, or Firm* — Jason A. Smith; Shumaker, Loop & Kendrick, LLP

(57) ABSTRACT

A method of removing deposits in a direct injection spark ignition engine, the method including combusting in the engine a gasoline fuel composition having a quaternary ammonium salt additive wherein the quaternary ammonium salt additive includes the quaternised reaction product of a hydrocarbyl substituted succinic acid derived acylating agent and a compound able to react with said acylating agent and which includes a tertiary amine group; in which each molecule of the hydrocarbyl substituted succinic acid derived acylating agent includes on average at least 1.2 succinic acid moieties.

16 Claims, No Drawings

(56) References Cited

U.S. PATENT DOCUMENTS

| | | | |
|---|---|---|---|
| 8,444,720 | B2 | 5/2013 | Colucci et al. |
| 9,062,265 | B2 | 6/2015 | Reid et al. |
| 10,150,927 | B2 | 12/2018 | Mezger et al. |
| 10,457,884 | B2 | 10/2019 | Russo et al. |
| 11,085,001 | B2 | 8/2021 | Castro et al. |
| 2007/0094922 | A1 | 5/2007 | Bergemann |
| 2009/0282731 | A1 | 11/2009 | Malfer et al. |
| 2012/0010112 | A1 | 1/2012 | Grabarse et al. |
| 2013/0031828 | A1 | 2/2013 | Reid et al. |
| 2013/0133245 | A1 | 5/2013 | Röger-Göpfert et al. |
| 2014/0100759 | A1 | 4/2014 | Lee |
| 2014/0157656 | A1 | 6/2014 | Reid |
| 2014/0157657 | A1 | 6/2014 | Reid |
| 2015/0337227 | A1 | 11/2015 | Reid |
| 2017/0121622 | A1 | 5/2017 | Burgess et al. |
| 2017/0121628 | A1 | 5/2017 | Moreton et al. |
| 2017/0130153 | A1 | 5/2017 | Peretolchin et al. |
| 2018/0187115 | A1 | 7/2018 | Reid |
| 2019/0153348 | A1 | 5/2019 | Arters et al. |
| 2019/0249099 | A1 | 8/2019 | Peretolchin et al. |
| 2020/0056109 | A1 | 2/2020 | Peretolchin et al. |
| 2020/0157445 | A1 | 5/2020 | Ross et al. |
| 2020/0354642 | A1 | 11/2020 | Reid |
| 2020/0377811 | A1 | 12/2020 | Petts et al. |
| 2021/0115347 | A1 | 4/2021 | Mulqueen et al. |

FOREIGN PATENT DOCUMENTS

| | | | |
|---|---|---|---|
| EP | 0356725 | A1 | 3/1990 |
| EP | 0565285 | B1 | 5/1997 |
| EP | 0700985 | B1 | 3/1999 |
| EP | 1250404 | A1 | 10/2002 |
| EP | 1295933 | A2 | 3/2003 |
| EP | 0870819 | B1 | 3/2004 |
| EP | 1226188 | B1 | 12/2004 |
| EP | 1254889 | B1 | 6/2007 |
| EP | 1229100 | B1 | 12/2010 |
| EP | 2631283 | B1 | 10/2018 |
| EP | 3609990 | A1 | 2/2020 |
| GB | 2493377 | A | 2/2013 |
| GB | 2518288 | A | 3/2015 |
| GB | 2520795 | B | 4/2018 |
| GB | 2564511 | A | 1/2019 |
| GB | 2564735 | A | 1/2019 |
| GB | 2564736 | A | 1/2019 |
| GB | 2546350 | B | 12/2019 |
| GB | 2578519 | A | 5/2020 |
| WO | 2001072930 | A2 | 10/2001 |
| WO | 2007015080 | A1 | 2/2007 |
| WO | 2009040582 | A1 | 4/2009 |
| WO | 2009040583 | A1 | 4/2009 |
| WO | 2011095819 | A1 | 8/2011 |
| WO | 2011110860 | A1 | 9/2011 |
| WO | 2011141731 | A1 | 11/2011 |
| WO | 2013017886 | A1 | 2/2013 |
| WO | 2013017887 | A1 | 2/2013 |
| WO | 2013017889 | A1 | 2/2013 |
| WO | 2015011505 | A1 | 1/2015 |
| WO | 2017/096175 | A1 | 6/2017 |
| WO | 2018007486 | A1 | 1/2018 |
| WO | 2018178674 | A1 | 10/2018 |
| WO | 2018178678 | A1 | 10/2018 |
| WO | 2018178680 | A1 | 10/2018 |
| WO | 2018178687 | A1 | 10/2018 |
| WO | 2018178695 | A1 | 10/2018 |
| WO | 2019186125 | A1 | 10/2019 |
| WO | 2021090020 | A1 | 5/2021 |
| WO | 2021090021 | A1 | 5/2021 |
| WO | 2023111549 | A1 | 6/2023 |
| WO | 2023111551 | A1 | 6/2023 |
| WO | 2023111552 | A1 | 6/2023 |

OTHER PUBLICATIONS

Written Opinion (WO) issued for PCT/GB2022/053214, dated Mar. 24, 2023 (6 pages).
International Search Report (ISR) issued for PCT/GB2022/053216, dated Mar. 16, 2023 (3 pages).
Written Opinion (WO) issued for PCT/GB2022/053216, dated Mar. 16, 2023 (3 pages).
International Search Report (ISR) issued for PCT/GB2022/053218, dated Mar. 22, 2023 (3 pages).
Written Opinion (WO) issued for PCT/GB2022/053218, dated Mar. 22, 2023 (6 pages).
International Search Report (ISR) issued for PCT/GB2022/053217, dated Mar. 22, 2023 (3 pages).
Written Opinion (WO) issued for PCT/GB2022/053217, dated Mar. 22, 2023 (6 pages).
Search Report issued for GB2118107.8, dated May 12, 2022 (1 page).
Search Report issued for GB2118104.5, dated May 12, 2022 (1 page).
Search Report issued for GB2188103.7, dated May 12, 2022 (2 pages).
Search Report issued for GB2118100.3. dated May 11, 2022 (2 pages).
Combined Search and Examination Report issued for GB22188130.0, dated Jun. 1, 2023 (2 pages).
Combined Search and Examination Report issued for GB2218812.2, dated Jun. 2, 2023 (3 pages).
Combined Search and Examination Report issued for GB2218811.4, dated May 26, 2023 (3 pages).
Combined Search and Examination Report issued for GB2218810.6, dated May 25, 2023 (2 pages).
Non-Final Office Action (NFOA) issued in U.S. Appl. No. 18/718,232, mailed Mar. 5, 2025 (29 pages).
Non-Final Office Action (NFOA) issued in U.S. Appl. No. 18/718,287, mailed Mar. 6, 2025 (17 pages).
Non-Final Office Action (NFOA) issued in U.S. Appl. No. 18/718,271, mailed Mar. 11, 2025 (14 pages).

METHODS AND USES RELATING TO FUEL COMPOSITIONS

This application is a 371 of PCT/GB2022/053216 filed Dec. 14, 2022.

TECHNICAL FIELD AND BACKGROUND

The present invention relates to fuel compositions, methods and uses relating thereto. In particular, the invention relates to additives for fuel used in spark ignition engines.

With over a hundred years of development the spark ignition (SI) engine has become a highly tuned piece of engineering. As the SI engine has become more highly tuned it has become more sensitive to variations in its construction. The construction of such engines can change with use as deposits build up on certain components and through wear of other components. These changes in construction may not only change parameters such as power output and overall efficiency; they can also significantly alter the pollutant emissions produced. To try and minimise these time-related changes to an engine's construction fuel additives have been developed to minimise wear and deposit build-up phenomena. Examples include anti valve seat recession additives to reduce wear and detergents to reduce deposit build-up.

As engine technology has evolved so have the demands put upon fuel additive packages.

Engine designers have developed injection systems where the fuel is injected directly into the combustion chamber. Such engines are alternatively known as direct injection spark ignition (DISI), direct injection gasoline (DIG), gasoline direct injection (GDI) etc. This injection strategy means that the fuel injector is subjected to higher temperatures and pressures. This increases the likelihood of forming deposits from the high temperature degradation of the fuel. The fact that the injector is in the combustion chamber also exposes the injector to combustion gases which may contain partially oxidised fuel and or soot particles which may accumulate, increasing the level of deposits. The ability to provide good atomisation of fuel and precise control of fuel flow rates and injection duration are critical to the optimum performance of these engine designs.

Effective control of deposits in a direct injection spark ignition engine is an important but challenging task. There is a continuing need to develop and improve additives for use in direct injection spark ignition engines.

The build up of deposits in a direct injection spark ignition engine can lead to changes in combustion efficiency and increased pollutant output.

SUMMARY

Therefore it is particularly desirable to provide additives which not only prevent or reduce the formation of deposits but which are also able to clean up or remove existing deposits.

It is also highly desirable to include deposit control additives at low treat rates. This not only provides obvious environmental and cost benefits but also reduces the possibility of antagonistic interaction between deposit control additives and other additives which may be present in the fuel.

The present inventors have surprisingly found that a particular class of quaternary ammonium compounds are very effective at removing deposits in direct injection spark injection engines, even at low treat rates.

DETAILED DESCRIPTION

According to a first aspect of the present invention there is provided a method of removing deposits in a direct injection spark ignition engine, the method comprising combusting in the engine a gasoline fuel composition comprising a quaternary ammonium salt additive; wherein the quaternary ammonium salt additive comprises the quaternised reaction product of a hydrocarbyl substituted succinic acid derived acylating agent and a compound able to react with said acylating agent and which includes a tertiary amine group; wherein each molecule of the hydrocarbyl substituted succinic acid derived acylating agent includes on average at least 1.2 succinic acid moieties.

According to a second aspect of the present invention there is provided the use of a quaternary ammonium salt additive in a gasoline fuel composition to remove deposits in a direct injection spark ignition engine; wherein the quaternary ammonium salt additive comprises the quaternised reaction product of a hydrocarbyl substituted succinic acid derived acylating agent and a compound able to react with said acylating agent and which includes a tertiary amine group; wherein each molecule of the hydrocarbyl substituted succinic acid derived acylating agent includes on average at least 1.2 succinic acid moieties.

Preferred features of the first and second aspects of the present invention will now be described.

The present invention involves the use of a quaternary ammonium salt which is the quaternised reaction product of a hydrocarbyl substituted succinic acid derived acylating agent and a compound able to react with said acylating agent and which includes a tertiary amine group.

For the avoidance of doubt reference to the quaternised reaction product is meant to refer to a reaction product which comprises the tertiary amine which has then been quaternised to form a quaternary ammonium group. The quaternary ammonium salt additive is formed by reacting a quaternising agent with the reaction product of a hydrocarbyl substituted succinic acid derived acylating agent and a compound able to react with said acylating agent and which includes a tertiary amine group.

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having predominantly hydrocarbon character. Examples of hydrocarbyl groups include:

(i) hydrocarbon groups, that is, aliphatic (which may be saturated or unsaturated, linear or branched, e.g., alkyl or alkenyl), alicyclic (e.g., cycloalkyl, cycloalkenyl) substituents, and aromatic (including aliphatic- and alicyclic-substituted aromatic) substituents, as well as cyclic substituents wherein the ring is completed through another portion of the molecule (e.g., two substituents together form a ring);

(ii) substituted hydrocarbon groups, that is, substituents containing non-hydrocarbon groups which, in the context of this invention, do not alter the predominantly hydrocarbon nature of the substituent (e.g., halo (e.g. chloro, fluoro or bromo), hydroxy, alkoxy (e.g. $C_1$ to $C_4$ alkoxy), keto, acyl, cyano, mercapto, amino, amido, nitro, nitroso, sulfoxy, nitryl and carboxy);

(iii) hetero substituents, that is, substituents which, while having a predominantly hydrocarbon character, in the context of this invention, contain other than carbon in a ring or chain otherwise composed of carbon atoms. Heteroatoms include sulphur, oxygen, nitrogen, and encompass substituents as pyridyl, furyl, thienyl and imidazolyl. In general, no more than two, preferably no more than one, non-hydrocarbon substituent will be present for every ten carbon atoms in the hydrocarbyl group; typically, there will be no non-hydrocarbon substituents in the hydrocarbyl group.

Suitable hydrocarbyl substituted succinic acid derived acylating agents and means of preparing them are well known in the art. For example a common method of preparing a hydrocarbyl substituted succinic acylating agent is by the reaction of maleic anhydride with an olefin using a chlorination route or a thermal route (the so-called "ene" reaction).

Illustrative of hydrocarbyl substituent based groups include n-octyl, n-decyl, n-dodecyl, tetrapropenyl, n-octadecyl, oleyl, chloroctadecyl, triicontanyl, etc. The hydrocarbyl based substituents may be made from homo- or interpolymers (e.g. copolymers, terpolymers) of mono- and di-olefins having 2 to 10 carbon atoms, for example ethylene, propylene, butane-1, isobutene, butadiene, isoprene, 1-hexene, 1-octene, etc. Preferably these olefins are 1-monoolefins. Alternatively the substituent may be made from other sources, for example monomeric high molecular weight alkenes (e.g. 1-tetra-contene), aliphatic petroleum fractions, for example paraffin waxes and cracked analogs thereof, white oils, synthetic alkenes for example produced by the Ziegler-Natta process (e.g. poly(ethylene) greases) and other sources known to those skilled in the art. Any unsaturation in the substituent may if desired be reduced or eliminated by hydrogenation according to procedures known in the art.

Preferably the hydrocarbyl substituents are predominantly saturated, that is, they contain no more than one carbon-to-carbon unsaturated bond for every ten carbon-to-carbon single bonds present. Most preferably they contain no more than one carbon-to-carbon non-aromatic unsaturated bond for every 50 carbon-to-carbon bonds present.

The hydrocarbyl substituent of the succinic acid derived acylating agent preferably comprises at least 10, more preferably at least 12, for example at least 30 or at least 40 carbon atoms. It may comprise up to about 200 carbon atoms. Preferably the hydrocarbyl substituent of the acylating agent has a number average molecular weight (Mn) of between 170 to 2800, for example from 250 to 1500, preferably from 500 to 1500 and more preferably 500 to 1100. An Mn of 700 to 1300 is especially preferred.

The hydrocarbyl substituted succinic acid derived acylating agent may comprise a mixture of compounds. For example a mixture of compounds having different hydrocarbyl substituents may be used.

Preferred hydrocarbyl-based substituents are polyisobutenes. Such compounds are known to the person skilled in the art.

Preferred hydrocarbyl substituted succinic acid derived acylating agents are polyisobutenyl succinic anhydrides. These compounds are commonly referred to as "PIBSAs" and are known to the person skilled in the art.

Conventional polyisobutenes and so-called "highly-reactive" polyisobutenes are suitable for use in the invention. Highly reactive polyisobutenes in this context are defined as polyisobutenes wherein at least 50%, preferably 70% or more, of the terminal olefinic double bonds are of the vinylidene type as described in EP0565285. Particularly preferred polyisobutenes are those having more than 80 mol % and up to 100 mol % of terminal vinylidene groups such as those described in U.S. Pat. No. 7,291,758. Preferred polyisobutenes have preferred molecular weight ranges as described above for hydrocarbyl substituents generally.

Other preferred hydrocarbyl groups include those having an internal olefin for example as described in the applicant's published application WO2007/015080.

An internal olefin as used herein means any olefin containing predominantly a non-alpha double bond, that is a beta or higher olefin. Preferably such materials are substantially completely beta or higher olefins, for example containing less than 10% by weight alpha olefin, more preferably less than 5% by weight or less than 2% by weight. Typical internal olefins include Neodene 1518IO available from Shell.

Internal olefins are sometimes known as isomerised olefins and can be prepared from alpha olefins by a process of isomerisation known in the art, or are available from other sources. The fact that they are also known as internal olefins reflects that they do not necessarily have to be prepared by isomerisation.

Preferred hydrocarbyl substituted succinic acid derived acylating agents for use in preparing additive of the present invention are polyisobutenyl substituted succinic anhydrides or PIBSAs. Especially preferred PIBSAs are those having a PIB molecular weight (Mn) of from 300 to 2800, preferably from 450 to 2300, more preferably from 500 to 1300.

The hydrocarbyl substituted succinic acid derived acylating agent is suitably prepared by reacting maleic anhydride with an alkene, for example a polyisobutene. The product obtained (such as a PIBSA) still includes a double bond. The maleic anhydride is present in the resultant molecule as a succinic acid moiety.

The monomaleated PIBSA may have the structure (A) or (B):

(A)

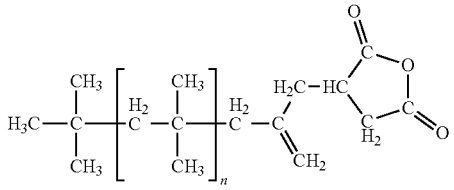

(B)

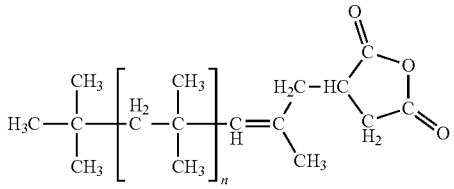

The double bond in the monomaleated product can react with a further molecule of maleic anhydride to form a bismaleated PIBSA having the structure (C) or (D):

(C)

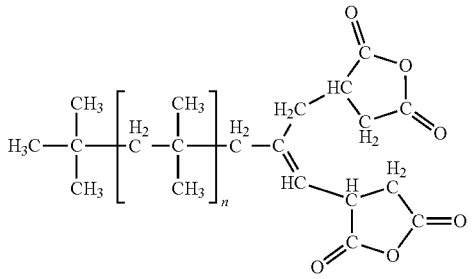

(D)

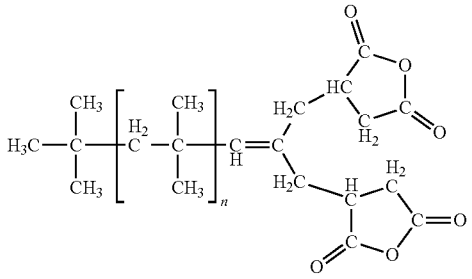

Thus it is possible to provide a hydrocarbyl group which is substituted with more than one succinic acid moiety. In such embodiments each molecule of the hydrocarbyl substituted succinic acid derived acylating agent includes more than one succinic acid moiety.

The skilled person will appreciate that the additives used in the invention typically comprise mixtures of compounds and will be prepared from a mixture of monomaleated and bismaleated PIBSAs. The PIBSAs may be defined in terms of their level of bismaleation.

One way in which this may be determined is by calculating the average number of succinic acid moieties per molecule of acylating agent.

A monomaleated PIBSA has one succinic acid moiety per module.

A bismaleated PIBSA has two succinic acid moieties per molecule.

A mixture comprising monomaleated PIBSA and bismaleated PIBSA in a 1:1 molar ratio would comprise an average of 1.5 succinic acid moieties per molecule of PIBSA.

The average number of succinic acid moieties per molecule of acylating agent is sometimes referred to in the art as "P value".

One way in which the P value can be determined empirically is described in relation to the examples.

The present invention relates in particular to the use of quaternary ammonium salts derived from hydrocarbyl substituted acylating agents which include an average of at least 1.2 succinic acid moieties per molecule.

As the skilled person will appreciate, a single molecule cannot have 1.2 succinic acid moieties. What is meant by at least 1.2 succinic acid moieties is the mean number of succinic acid moieties per molecule of acylating agent as the sum of all the succinic acid moieties present in a sample divided by the total number of molecules of acylating agent having one or more succinic acid moieties present in the sample.

The present inventors have surprisingly found that when the quaternary ammonium salt additive is prepared from a hydrocarbyl substituted succinic acid derived acylating agent comprising on average at least 1.2 succinic acid moieties per molecule removal of deposits in a direct injection spark ignition engine is achieved.

Preferably the hydrocarbyl substituted succinic acid derived acylating agent comprises on average at least 1.21 succinic acid moieties per molecule, more preferably at least 1.22 succinic acid moieties per molecule.

In some embodiments the hydrocarbyl substituted succinic acid derived acylating agent may comprise at least 1.23 or at least 1.24 succinic acid moieties per molecule.

In some embodiments the hydrocarbyl substituted succinic acid derived acylating agent may comprise at least 1.25, at least 1.26 or at least 1.27 succinic acid moieties per molecule.

In some embodiments the hydrocarbyl substituted succinic acid derived acylating agent may comprise at least 1.28, at least 1.29 or at least 1.30 succinic acid moieties per molecule.

By succinic acid moiety we mean to include residues of succinic acid present in diacid or anhydride form.

The hydrocarbyl substituted succinic acid derived acylating agent is reacted with a compound able to react with said acylating agent and which includes a tertiary amine group. The tertiary amine group is quaternised to provide the quaternary ammonium salt additive.

Examples of suitable compounds able to react with the hydrocarbyl substituted succinic acid derived acylating agent and which include a tertiary amine group can include but are not limited to: N,N-dimethylaminopropylamine, N,N-diethylaminopropylamine, N,N-dimethylamino ethylamine. The nitrogen or oxygen containing compounds capable of condensing with the acylating agent and further having a tertiary amino group can further include amino alkyl substituted heterocyclic compounds such as 1-(3-aminopropyl)imidazole and 4-(3-aminopropyl)morpholine, 1-(2-aminoethyl)piperidine, 3,3-diamino-N-methyldipropylamine, and 3'3-aminobis(N,N-dimethylpropylamine). Other types of nitrogen or oxygen containing compounds capable of condensing with the acylating agent and having a tertiary amino group include alkanolamines including but not limited to triethanolamine, trimethanolamine, N,N-dimethylaminopropanol, N, N-dimethylaminoethanol, N,N-diethylaminopropanol, N,N-diethylaminoethanol, N,N-diethylaminobutanol, N, N, N-tris(hydroxyethyl)amine, N,N,N-tris(hydroxymethyl)amine, N,N,N-tris(aminoethyl)amine, N,N-dibutylaminopropylamine and N,N,N'-trimethyl-N'-hydroxyethyl-bisaminoethylether; N,N-bis(3-dimethylaminopropyl)-N-isopropanolamine; N-(3-dimethylaminopropyl)-N,N-diisopropanolamine; N'-(3-(dimethylamino)propyl)-N, N-dimethyl 1,3-propanediamine; 2-(2-dimethylaminoethoxy) ethanol, N,N,N'-trimethylaminoethylethanolamine and 3-(2-(dimethylamino)ethoxy)propylamine.

Preferably the compound able to react with hydrocarbyl substituted succinic acid derived acylating agent and which includes a tertiary amine group is an amine of formula (I) or (II):

(I)

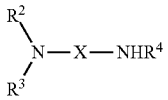

(II)

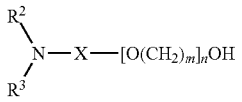

wherein $R^2$ and $R^3$ are the same or different alkyl, alkenyl, aryl, alkaryl or aralkyl groups having from 1 to 22 carbon atoms; X is a bond or an optionally substituted alkylene group having from 1 to 20 carbon atoms; n is from 0 to 20; m is from 1 to 5; and $R^4$ is hydrogen or a $C_1$ to $C_{22}$ alkyl group.

When a compound of formula (I) is used, $R^4$ is preferably hydrogen or a $C_1$ to $C_{16}$ alkyl group, preferably a $C_1$ to $C_{10}$ alkyl group, more preferably a $C_1$ to $C_6$ alkyl group. When $R^4$ is alkyl it may be straight chained or branched. It may be substituted for example with a hydroxy or alkoxy substituent. Preferably $R^4$ is not a substituted alkyl group. More preferably $R^4$ is selected from hydrogen, methyl, ethyl, propyl, butyl and isomers thereof. Most preferably $R^4$ is hydrogen.

When a compound of formula (II) is used, m is preferably 2 or 3, most preferably 2; n is preferably from 0 to 15, preferably 0 to 10, more preferably from 0 to 5. Most preferably n is 0 and the compound of formula (II) is an alcohol.

Preferably the hydrocarbyl substituted acylating agent is reacted with a diamine compound of formula (I).

$R^2$ and $R^3$ are the same or different alkyl, alkenyl, aryl, alkaryl or aralkyl groups having from 1 to 22 carbon atoms. In some embodiments $R^2$ and $R^3$ may be joined together to form a ring structure, for example a piperidine, imidazole or morpholine moiety. Thus $R^2$ and $R^3$ may together form an aromatic and/or heterocyclic moiety. $R^2$ and $R^3$ may be branched alkyl or alkenyl groups. Each may be substituted, for example with a hydroxy or alkoxy substituent.

Preferably each of $R^2$ and $R^3$ is independently a $C_1$ to $C_{16}$ alkyl group, preferably a $C_1$ to $C_{10}$ alkyl group. $R^2$ and $R^3$ may independently be methyl, ethyl, propyl, butyl, pentyl, hexyl, heptyl, octyl, or an isomer of any of these. Preferably $R^2$ and $R^3$ is each independently $C_1$ to $C_4$ alkyl. Preferably $R^2$ is methyl. Preferably $R^3$ is methyl.

X is a bond or an optionally substituted alkylene group having from 1 to 20 carbon atoms. In preferred embodiments when X is an alkylene group this group may be straight chained or branched. The alkylene group may include a cyclic structure therein. It may be optionally substituted, for example with a hydroxy or alkoxy substituent. In some embodiments X may include a heteroatom within the alkylene chain, for example X may include an ether functionality.

X is preferably an alkylene group having 1 to 16 carbon atoms, preferably 1 to 12 carbon atoms, more preferably 1 to 8 carbon atoms, for example 2 to 6 carbon atoms or 2 to 5 carbon atoms.

In some preferred embodiments X is an unsubstituted alkylene group. Most preferably X is an ethylene, propylene or butylene group, especially a propylene group.

Examples of compounds of formula (I) suitable for use herein include 1-aminopiperidine, 1-(2-aminoethyl)piperidine, 1-(3-aminopropyl)-2-pipecoline, 1-methyl-(4-methylamino)piperidine, 4-(1-pyrrolidinyl)piperidine, 1-(2-aminoethyl) pyrrolidine, 2-(2-aminoethyl)-1-methylpyrrolidine, N,N-diethylethylenediamine, N,N-dimethylethylenediamine, N,N-dibutylethylenediamine, N,N-diethyl-1,3-diaminopropane, N,N-dimethyl-1,3-diaminopropane, N,N,N'-trimethylethylenediamine, N,N-dimethyl-N'-ethylethylenediamine, N,N-diethyl-N'-methylethylenediamine, N,N,N'-triethylethylenediamine, 3-dimethylaminopropylamine, 3-diethylaminopropylamine, 3-dibutylaminopropylamine, N,N,N'-trimethyl-1,3-propanediamine, N,N,2,2-tetramethyl-1,3-propanediamine, 2-amino-5-diethylaminopentane, N,N,N',N'-tetraethyldiethylenetriamine, 3,3'-diamino-N-methyldipropylamine, 3,3'-iminobis(N,N-dimethylpropylamine), 1-(3-aminopropyl) imidazole and 4-(3-aminopropyl)morpholine, 1-(2-aminoethyl)piperidine, 3,3-diamino-N-methyldipropylamine, 3,3-aminobis(N,N-dimethyl propylamine), 3-(2-(dimethylamino)ethoxy)propylamine, or combinations thereof.

In some preferred embodiments the compound of formula (I) is selected from from N,N-dimethyl-1,3-diaminopropane, N,N-diethyl-1,3-diaminopropane, N,N-dimethylethylenediamine, N,N-diethylethylenediamine, N,N-dibutylethylenediamine, 3-(2-(dimethylamino)ethoxy)propylamine, or combinations thereof.

Examples of compounds of formula (II) suitable for use herein include alkanolamines including but not limited to triethanolamine, N, N-dimethylaminopropanol, N,N-diethylaminopropanol, N,N-diethylaminobutanol, triisopropanolamine, 1-[2-hydroxyethyl]piperidine, 2-[2-(dimethylamine)ethoxy]-ethanol, N-ethyldiethanolamine, N-methyldiethanolamine, N-butyldiethanolamine, N,N-diethylaminoethanol, N,N-dimethyl amino-ethanol, 2-dimethylamino-2-methyl-1-propanol, N,N,N'-trimethyl-N'-hydroxyethyl-bisaminoethylether; N,N-bis(3-dimethylaminopropyl)-N-isopropanolamine; N-(3-dimethylaminopropyl)-N,N-diisopropanolamine; N'-(3-(dimethylamino)propyl)-N,N-dimethyl 1,3-propanediamine; 2-(2-dimethylaminoethoxy) ethanol, and N,N,N'-trimethylaminoethylethanolamine.

In some preferred embodiments the compound of formula (II) is selected from Triisopropanolamine, 1-[2-hydroxyethyl]piperidine, 2-[2-(dimethylamine)ethoxy]-ethanol, N-ethyldiethanolamine, N-methyldiethanolamine, N-butyldiethanolamine, N,N-diethylaminoethanol, N,N-dimethylaminoethanol, 2-dimethylamino-2-methyl-1-propanol, or combinations thereof.

An especially preferred compound of formula (I) is N,N-dimethyl-1,3-diaminopropane (dimethylaminopropylamine).

When a compound of formula (II) is reacted with a succinic acylating agent the resulting product is a succinic ester. When a succinic acylating agent is reacted with a compound of formula (I) in which $R^4$ is hydrogen the resulting product may be a succinimide or a succinamide. When a succinic acylating agent is reacted with a compound of formula (I) in which $R^4$ is not hydrogen the resulting product is an amide.

To form the quaternary ammonium salt additive the hydrocarbyl substituted succinic acid derived acylating agent is reacted with a compound able to react with said acylating agent and which includes a tertiary amine group. This reaction product is then quaternised by reaction with a quaternising agent.

The reaction product of the acylating agent and compound which includes a tertiary amine group is preferably reacted with at least one molar equivalent of quaternising agent per mole of tertiary amine group present in the reaction product.

Preferably the reaction product of the acylating agent and compound which includes a tertiary amine group is reacted with more than one molar equivalent of quaternising agent per mole of tertiary amine group present in the reaction product, preferably at least 1.2 molar equivalents of quaternising agent per mole of tertiary amine group, more preferably at least 1.5 molar equivalents of quaternising agent, suitably at least 1.7 molar equivalents of quaternising agent, for example at least 1.9 molar equivalents of quaternising agent.

Preferably the reaction product of the acylating agent and compound which includes a tertiary amine group is reacted with two or more molar equivalents of quaternising agent per mole of tertiary amine group present in the reaction product, preferably at least 2.1 molar equivalents of quaternising agent.

In some embodiments the reaction product of the acylating agent and compound which includes a tertiary amine group is reacted with more than 2.2 molar equivalents of quaternising agent per mole of tertiary amine group present in the reaction product, for example from 2.3 to 4 molar equivalents, from 2.3 to 3 molar equivalents, or from 2.3 to 2.7 or from 2.5 to 3 molar equivalents.

Any suitable quaternising agent may be used. The quaternising agent may suitably be selected from esters and non-esters.

Suitable quaternising agents include esters of a carboxylic acid, dialkyl sulfates, benzyl halides, hydrocarbyl substituted carbonates, hydrocarbyl substituted epoxides optionally in combination with an acid, alkyl halides, alkyl sulfonates, sultones, hydrocarbyl substituted phosphates, hydrocarbyl substituted borates, alkyl nitrites, alkyl nitrates, hydroxides, N-oxides, chloroacetic acid or salts thereof, or mixtures thereof.

In some preferred embodiments, quaternising agents used to form the quaternary ammonium salt additives of the present invention are esters.

Preferred ester quaternising agents are compounds of formula (III):

(III)

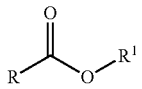

in which R is an optionally substituted alkyl, alkenyl, aryl or alkylaryl group and R1 is a C1 to C22 alkyl, aryl or alkylaryl group. The compound of formula (III) is suitably an ester of a carboxylic acid capable of reacting with a tertiary amine to form a quaternary ammonium salt.

Suitable quaternising agents include esters of carboxylic acids having a pKa of 3.5 or less.

The compound of formula (III) is preferably an ester of a carboxylic acid selected from a substituted aromatic carboxylic acid, an α-hydroxycarboxylic acid and a polycarboxylic acid.

In some preferred embodiments the compound of formula (III) is an ester of a substituted aromatic carboxylic acid and thus R is a substituted aryl group.

Preferably R is a substituted aryl group having 6 to 10 carbon atoms, preferably a phenyl or naphthyl group, most preferably a phenyl group. R is suitably substituted with one or more groups selected from carboalkoxy, nitro, cyano, hydroxy, SR5 or NR5R6. Each of R5 and R6 may be hydrogen or optionally substituted alkyl, alkenyl, aryl or carboalkoxy groups. Preferably each of R5 and R6 is hydrogen or an optionally substituted C1 to C22 alkyl group, preferably hydrogen or a C1 to C16 alkyl group, preferably hydrogen or a C1 to C10 alkyl group, more preferably hydrogen or a C1 to C4 alkyl group. Preferably R5 is hydrogen and R6 is hydrogen or a C1 to C4 alkyl group. Most preferably R5 and R6 are both hydrogen. Preferably R is an aryl group substituted with one or more groups selected from hydroxyl, carboalkoxy, nitro, cyano and $NH_2$. R may be a poly-substituted aryl group, for example trihydroxyphenyl. In some embodiments R may be a hydrocarbyl substituted aryl group, for example an alkyl substituted aryl group. In some embodiments R may be an aryl group substituted with a hydroxy group and a hydrocarbyl group, such as an alkyl group, for example as described in EP2631283.

Preferably R is a mono-substituted aryl group. Preferably R is an ortho substituted aryl group. Suitably R is substituted with a group selected from OH, NH2, NO2 or COOMe. Preferably R is substituted with an OH or $NH_2$ group. Suitably R is a hydroxy substituted aryl group. Most preferably R is a 2-hydroxyphenyl group.

Preferably $R^1$ is an alkyl, aralkyl or alkaryl group. $R^1$ may be a C1 to C16 alkyl group, preferably a C1 to C10 alkyl group, suitably a C1 to C8 alkyl group. $R^1$ may be C7 to C16 aralkyl or alkaryl group, preferably a C7 to C10 aralkyl or alkaryl group. $R^1$ may be methyl, ethyl, propyl, butyl, pentyl, benzyl or an isomer thereof. Preferably $R^1$ is benzyl or methyl. Most preferably $R^1$ is methyl.

Especially preferred compounds of formula (III) are lower alkyl esters of salicylic acid such as methyl salicylate, ethyl salicylate, n and i propyl salicylate, and butyl salicylate, preferably methyl salicylate.

In some embodiments the compound of formula (III) is an ester of an α-hydroxycarboxylic acid. In such embodiments the compound has the structure:

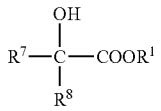

wherein R7 and R8 are the same or different and each is selected from hydrogen, alkyl, alkenyl, aralkyl or aryl. Compounds of this type suitable for use herein are described in EP 1254889.

Examples of compounds of formula (III) in which RCOO is the residue of an α-hydroxycarboxylic acid include methyl-, ethyl-, propyl-, butyl-, pentyl-, hexyl-, benzyl-, phenyl-, and allyl esters of 2-hydroxyisobutyric acid; methyl-, ethyl-, propyl-, butyl-, pentyl-, hexyl-, benzyl-, phenyl-, and allyl esters of 2-hydroxy-2-methylbutyric acid; methyl-, ethyl-, propyl-, butyl-, pentyl-, hexyl-, benzyl-, phenyl-, and allyl esters of 2-hydroxy-2-ethylbutyric acid; methyl-, ethyl-, propyl-, butyl-, pentyl-, hexyl-, benzyl-, phenyl-, and allyl esters of lactic acid; and methyl-, ethyl-, propyl-, butyl-, pentyl-, hexyl-, allyl-, benzyl-, and phenyl esters of glycolic acid. Of the above, a preferred compound is methyl 2-hydroxyisobutyrate.

In some embodiments the compound of formula (III) is an ester of a polycarboxylic acid. In this definition we mean to include dicarboxylic acids and carboxylic acids having more than 2 acidic moieties. In such embodiments RCOO is preferably present in the form of an ester, that is the one or more further acid groups present in the group R are in esterified form. However embodiments in which not all acid groups are esterified are within the invention. Mixed esters of polycarboxylic acids may also be used. Preferred esters are C1 to C4 alkyl esters.

The ester quaternising agent may be selected from the diester of oxalic acid, the diester of phthalic acid, the diester of maleic acid, the diester of malonic acid or the diester of citric acid.

One especially preferred compound of formula (III) is dimethyl oxalate.

In preferred embodiments the compound of formula (III) is an ester of a carboxylic acid having a pKa of less than 3.5. In such embodiments in which the compound includes more than one acid group, we mean to refer to the first dissociation constant.

The ester quaternising agent may be selected from an ester of a carboxylic acid selected from one or more of oxalic acid, phthalic acid, salicylic acid, maleic acid, malonic acid, citric acid, nitrobenzoic acid, aminobenzoic acid and 2, 4, 6-trihydroxybenzoic acid.

Preferred ester quaternising agents include dimethyl oxalate, methyl 2-nitrobenzoate and methyl salicylate.

In some preferred embodiments, quaternising agents used to form the quaternary ammonium salt additives of the present invention are esters selected from dimethyl oxalate, methyl 2-nitrobenzoate and methyl salicylate, preferably dimethyl oxalate and methyl salicylate.

Suitable non-ester quaternising agents include dialkyl sulfates, benzyl halides, hydrocarbyl substituted carbonates, hydrocarbyl substituted epoxides optionally in combination with an acid, alkyl halides, alkyl sulfonates, sultones, hydrocarbyl substituted phosphates, hydrocarbyl substituted borates, alkyl nitrites, alkyl nitrates, hydroxides, N-oxides, chloroacetic acid or salts thereof, or mixtures thereof.

In some embodiments the quaternary ammonium salt may be prepared from, for example, an alkyl or benzyl halide (especially a chloride) and then subjected to an ion exchange reaction to provide a different anion as part of the quaternary ammonium salt. Such a method may be suitable to prepare quaternary ammonium hydroxides, alkoxides, nitrites or nitrates.

Preferred non-ester quaternising agents include dialkyl sulfates, benzyl halides, hydrocarbyl substituted carbonates, hydrocarbyl substituted epoxides in combination with an acid, alkyl halides, alkyl sulfonates, sultones, hydrocarbyl substituted phosphates, hydrocarbyl substituted borates, N-oxides, chloroacetic acid or salts thereof, or mixtures thereof.

Suitable dialkyl sulfates for use herein as quaternising agents include those including alkyl groups having 1 to 10, preferably 1 to 4 carbons atoms in the alkyl chain. A preferred compound is dimethyl sulfate.

Suitable benzyl halides include chlorides, bromides and iodides. The phenyl group may be optionally substituted, for example with one or more alkyl or alkenyl groups, especially when the chlorides are used. A preferred compound is benzyl bromide.

Suitable hydrocarbyl substituted carbonates may include two hydrocarbyl groups, which may be the same or different. Each hydrocarbyl group may contain from 1 to 50 carbon atoms, preferably from 1 to 20 carbon atoms, more preferably from 1 to 10 carbon atoms, suitably from 1 to 5 carbon atoms. Preferably the or each hydrocarbyl group is an alkyl group. Preferred compounds of this type include diethyl carbonate and dimethyl carbonate.

Suitable hydrocarbyl substituted epoxides have the formula:

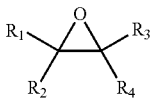

wherein each of R1, R2, R3 and R4 is independently hydrogen or a hydrocarbyl group having 1 to 50 carbon atoms. Examples of suitable epoxides include ethylene oxide, propylene oxide, butylene oxide, styrene oxide and stilbene oxide. The hydrocarbyl epoxides are used as quaternising agents in combination with an acid.

The hydrocarbyl substituted succinic acylating agent includes two acyl groups. In some embodiments only one of these groups reacts with the compound of formula (I) or formula (II) to form a compound having an ester or an amide functional group and a free carboxylic acid. In these embodiments if an epoxide is used as the quaternising agent, no separate acid needs to be added. However in other embodiments an acid for example acetic acid may be used.

Especially preferred epoxide quaternising agents are propylene oxide and styrene oxide, optionally in combination with an additional acid.

Suitable alkyl halides for use herein include chlorides, bromides and iodides.

Suitable alkyl sulfonates include those having 1 to 20, preferably 1 to 10, more preferably 1 to 4 carbon atoms.

Suitable sultones include propane sultone and butane sultone.

Suitable hydrocarbyl substituted phosphates include monoalkyl phosphates, dialkyl phosphates, trialkyl phosphates and O,O-dialkyl dithiophospates. Preferred alkyl groups have 1 to 12 carbon atoms.

Suitable hydrocarbyl substituted borate groups include alkyl borates having 1 to 12 carbon atoms.

Preferred alkyl nitrites and alkyl nitrates have 1 to 12 carbon atoms.

Preferably the non-ester quaternising agent is selected from dialkyl sulfates, benzyl halides, hydrocarbyl substituted carbonates, hydrocarbyl substituted epoxides optionally in combination with an additional acid, chloroacetic acid or a salt thereof, and mixtures thereof.

Especially preferred non-ester quaternising agents for use herein are hydrocarbyl substituted epoxides in combination with an acid. These may include embodiments in which a separate acid is provided or embodiments in which the acid is provided by the tertiary amine compound that is being quaternised. Preferably the acid is provided by the tertiary amine molecule that is being quaternised.

Preferred quaternising agents for use herein include dimethyl oxalate, methyl 2-nitrobenzoate, methyl salicylate, chloroacetic acid or a salt thereof, and styrene oxide or propylene oxide optionally in combination with an additional acid.

In some embodiments mixtures of two or more quaternising agents may be used.

To form some preferred quaternary ammonium salt additives of the present invention the compound of formula (III) is reacted with a compound formed by the reaction of a hydrocarbyl substituted succinic acid acylating agent and an amine of formula (I) or (II).

The compounds of formula (I) or formula (II) are as described above.

The amine of formula (I) or (II) is reacted with a hydrocarbyl substituted succinic acid derived acylating agent such as a succinic acid or succinic anhydride.

Suitably approximately one equivalent of amine is added per succinic acid moiety present in the acylating agent. The ratio of amine used will thus typically depend on the average number of succinic acid moieties present in each molecule of the acylating agent.

An especially preferred quaternary ammonium salt for use herein is formed by reacting methyl salicylate or dimethyl oxalate with the reaction product of a polyisobutylene-substituted succinic anhydride having a PIB molecular weight of 700 to 1300 and dimethylaminopropylamine; wherein the polyisobutylene-substituted succinic anhydride includes on average at least 1.2 succinic acid moieties per molecule.

US2012/0010112 describes an acid-free process for preparing quaternized nitrogen compounds, wherein a) a compound comprising at least one oxygen- or nitrogen-containing group reactive with the anhydride and additionally comprising at least one quaternizable amino group is added onto a polycarboxylic anhydride compound, and b) the product from stage a) is quaternized using an epoxide quaternizing agent without an additional acid. Such methods could be used to prepare the quaternary ammonium salt additives of the present invention.

In some embodiments the gasoline fuel composition may further comprise one or more additional deposit control additives.

In some embodiments the first aspect of the present invention provides a method of removing deposits in direct injection spark ignition engine, the method comprising combusting in the engine a gasoline fuel composition comprising a quaternary ammonium salt additive; and one or more additional deposit control additives; wherein the quaternary ammonium salt additive comprises the quaternised reaction product of a hydrocarbyl substituted succinic acid derived acylating agent and a compound able to react with said acylating agent and which includes a tertiary amine group; wherein each molecule of the hydrocarbyl substituted succinic acid derived acylating agent includes on average at least 1.2 succinic acid moieties.

In some embodiments the second aspect of the present invention provides the use of a combination of a quaternary ammonium salt additive and one or more additional deposit control additives in a gasoline fuel composition to remove deposits in a direct injection spark ignition engine; wherein the quaternary ammonium salt additive comprises the quaternised reaction product of a hydrocarbyl substituted succinic acid derived acylating agent and a compound able to react with said acylating agent and which includes a tertiary amine group; wherein each molecule of the hydrocarbyl substituted succinic acid derived acylating agent includes on average at least 1.2 succinic acid moieties.

The present invention may involve the use of an additional deposit control additive. Suitably the additional deposit control additive is not a quaternary ammonium salt additive as previously defined herein may be used.

The additional additive is referred to herein as a deposit control additive since in the present invention this component, along with the quaternary ammonium salt additive when used in a fuel composition removes deposits in a direct injection spark ignition engine.

Preferably the additional deposit control additive is selected from one or more of:

(i) carrier oils;
(ii) polyether amines;
(iii) acylated nitrogen compounds which are the reaction product of a carboxylic acid-derived acylating agent and an amine;
(iv) hydrocarbyl-substituted amines wherein the hydrocarbyl substituent is substantially aliphatic and contains at least 8 carbon atoms; and
(v) mannich base additives comprising nitrogen-containing condensates of a phenol, aldehyde and primary or secondary amine.

Preferably the ratio of the quaternary ammonium salt additive to the one or more additional deposit control additives, when present, is 1:100 to 100:1, preferably 1:50: 50:1, preferably 1:15 to 20:1 preferably 1:15 to 10:1 preferably 1:10 to 10:1 preferably 1:5 to 5:1.

All ratios are weight ratios on an active basis.

In some embodiments the one or more additional deposit control additives comprises a carrier oil.

The carrier oil may have any suitable molecular weight. A preferred molecular weight is in the range 500 to 5000.

In one embodiment the carrier oil may comprise an oil of lubricating viscosity. The oil of lubricating viscosity includes natural or synthetic oils of lubricating viscosity, oil derived from hydrocracking, hydrogenation, hydrofinishing, unrefined, refined and re-refined oils, or mixtures thereof.

In another embodiment the carrier oil may comprise a polyether carrier oil.

In a preferred embodiment the carrier oil is a polyalkyleneglycol monoether of the formula:

(C1)

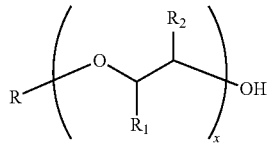

where R is a hydrocarbyl group having from 1 to 30 carbon atoms; R1 and R2 are each independently hydrogen or lower alkyl having from about 1 to about 6 carbon atoms and each $R_1$ and $R_2$ is independently selected in each —O—$CHR_1$—$CHR_2$— unit; and x is an integer of from 5 to 100, preferably 10 to 50, preferably 10 to 30, preferably 10-25, more preferably 12 to 25, more preferably 12 to 20.

In a preferred embodiment R is a straight chain $C_1$-$C_{30}$ alkyl, preferably $C_4$-$C_{20}$ alkyl, preferably $C_8$-$C_{18}$ alkyl, and more preferably $C_{12}$-$C_{18}$ alkyl or $C_8$-$C_{14}$ alkyl.

In another preferred embodiment R is an alkylphenyl group preferably an alkylphenyl group, wherein the alkyl moiety is a straight or branched chain alkyl of from about 1 to about 24 carbon atoms.

Preferably, one of $R_1$ and $R_2$ is lower alkyl of 1 to 4 carbon atoms, and the other is hydrogen. More preferably, one of $R_1$ and $R_2$ is methyl or ethyl, and the other is hydrogen.

In a preferred embodiment the carrier oil is a polypropyleneglycol monoether of the formula (C1) wherein R, and x are as defined above, and in each repeat unit one of $R_1$ and $R_2$ are hydrogen and the other is methyl.

In a further aspect the polyalkyleneglycol may be an ester. In this aspect the carrier oil may be a polypropyleneglycol monoester of the formula (C2)

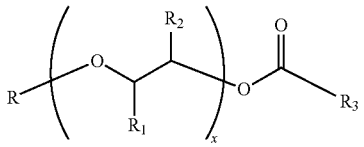

where R, $R_1$, $R_2$ and x are as defined for (C1) above and $R_3$ is a $C_1$-$C_{30}$ hydrocarbyl group, preferably an aliphatic hydrocarbyl group, and more preferably $C_1$-$C_{10}$ alkyl.

Suitable carrier oils include the hydrocarbyl-terminated poly(oxyalkylene) monools described in U.S. Pat. No. 4,877,416. These hydrocarbyl-terminated poly(oxyalkylene) polymers are monohydroxy compounds, i.e., alcohols, often termed monohydroxy polyethers, or polyalkylene glycol monohydrocarbylethers, or "capped" poly(oxyalkylene) glycols. The hydrocarbyl-terminated poly(oxyalkylene) alcohols may be prepared by the addition of lower alkylene oxides, such as ethylene oxide, propylene oxide, the butylene oxides, or the pentylene oxides to the alcohol $R^3OH$ under polymerization conditions, wherein $R^3$ is the hydrocarbyl group which caps the poly(oxyalkylene) chain. In the polymerization reaction a single type of alkylene oxide may be employed, e.g., propylene oxide, to provide a homopolymer, e.g., a poly(oxyalkylene) propanol. However, copolymers may also be useful. Random copolymers may be prepared by contacting the hydroxyl-containing compound with a mixture of alkylene oxides, such as a mixture of propylene and butylene oxides. Block copolymers can be prepared by contacting the hydroxyl-containing compound with first one alkylene oxide, then the others in any order, or repetitively, under polymerization conditions. One suitable block copolymer is prepared by polymerizing propylene oxide on a suitable monohydroxy compound to form a poly(oxypropylene) alcohol and then polymerizing butylene oxide on the poly(oxyalkylene) alcohol.

Suitable polyether carrier oils suitable for use herein can be represented by the formula:

$$R^4O—R^3O—_pH$$

wherein $R_4$ is a hydrocarbyl group of from 1 to 30 carbon atoms; $R^3$ is a $C_2$ to $C_5$ alkylene group; and p is an integer, such that the molecular weight of the polyether is from about 500 to about 5,000.

Preferably $R^3$ is a $C_3$ or $C_4$ alkylene group.

Preferably $R^4$ is a $C_7$-$C_{30}$ alkylphenyl group.

Preferably, the polyether has a molecular weight of from about 750 to about 3,000; and more preferably from about 900 to about 1,500.

In some embodiments the one or more additional deposit control additives comprises a polyetheramine.

It is known to those skilled in the art that the class of compounds known as polyetheramines function as deposit control additives. It is common for polyetheramines to be used as detergents and/or as carrier oils.

Suitable hydrocarbyl-substituted polyoxyalkylene amines or polyetheramines employed in the present invention are described in the literature (for example U.S. Pat. Nos. 6,217,624 and 4,288,612) and have the general formula:

(C4)

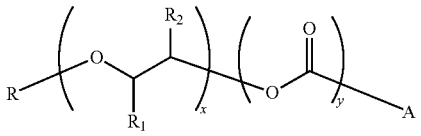

or a fuel-soluble salt thereof; R, $R_1$, $R_2$ and x are as defined for (C1) above; A is amino, N-alkyl amino having about 1 to about 20 carbon atoms in the alkyl group, N,N-dialkyl amino having about 1 to about 20 carbon atoms in each alkyl group, or a polyamine moiety having about 2 to about 12 amine nitrogen atoms and about 2 to about 40 carbon atoms; and y is 0 or 1.

In general, A is amino, N-alkyl amino having from about 1 to about 20 carbon atoms in the alkyl group, preferably about 1 to about 6 carbon atoms, more preferably about 1 to about 4 carbon atoms; N,N-dialkyl amino having from about 1 to about 20 carbon atoms in each alkyl group, preferably about 1 to about 6 carbon atoms, more preferably about 1 to about 4 carbon atoms; or a polyamine moiety having from about 2 to about 12 amine nitrogen atoms and from about 2 to about 40 carbon atoms, preferably about 2 to 12 amine nitrogen atoms and about 2 to 24 carbon atoms. More preferably, A is amino or a polyamine moiety derived from a (poly)alkylene polyamine, including alkylene diamine. Most preferably, A is amino or a polyamine moiety derived from ethylene diamine or diethylene triamine.

The polyetheramines will generally have a molecular weight in the range from about 600 to about 10,000.

Other suitable polyetheramines are those taught in U.S. Pat. Nos. 5,089,029, 5,112,364, EP310875, EP356725, EP700985, U.S. Pat. Nos. 6,217,624, 2,488,612 and 5,089,029.

In some embodiments the one or more additional deposit control additives comprises an acylated nitrogen compound which is the reaction product of a carboxylic acid-derived acylating agent and an amine.

The carboxylic derived acylating agent may be a hydrocarbyl substituted acylating agent as described for the quaternary ammonium salt(s).

Amines useful for reaction with these acylating agents include the following:

(1) (poly)alkylene polyamines of the general formula:

$$(R^3)_2N[U—N(R^3)]_nR^3$$

wherein each $R^3$ is independently selected from a hydrogen atom, a hydrocarbyl group or a hydroxy-substituted hydrocarbyl group containing up to about 30 carbon atoms, with proviso that at least one $R^3$ is a hydrogen atom, n is a whole number from 1 to 10 and U is a C1-18 alkylene group. Preferably each $R^3$ is independently selected from hydrogen, methyl, ethyl, propyl, isopropyl, butyl and isomers thereof. Most preferably each $R^3$ is ethyl or hydrogen. U is preferably a C1-4 alkylene group, most preferably ethylene.

Specific examples of (poly)alkylene polyamines (1) include ethylenediamine, diethylenetriamine, triethylenetetramine, tetraethylenepentamine, tri (tri-methylene)tetramine, pentaethylenehexamine, hexaethylene-heptamine, 1,2-propylenediamine, and other commercially available materials which comprise complex mixtures of polyamines.

Specific examples of (poly)alkylene polyamines (1) which are hydroxyalkyl-substituted polyamines include N-(2-hydroxyethyl) ethylene diamine, N,N'-bis(2-hydroxyethyl)ethylene diamine, N-(3-hydroxybutyl) tetramethylene diamine, etc.

(2) heterocyclic-substituted polyamines including hydroxyalkyl-substituted polyamines wherein the polyamines are as described above and the heterocyclic substituent is selected from nitrogen-containing aliphatic and aromatic heterocycles, for example piperazines, imidazolines, pyrimidines, morpholines, etc.

(3) aromatic polyamines of the general formula:

$$Ar(NR^3{}_2)_y$$

wherein Ar is an aromatic nucleus of 6 to 20 carbon atoms, each $R^3$ is as defined above including the proviso that at least one $R^3$ is a hydrogen atom and y is from 2 to 8.

4) The amine reactant may alternatively be a compound of general formula $R^3{}_3N$ wherein each $R^3$ is as defined in (1) above including the proviso that at least one R3 is a hydrogen atom.

Further amines which may be used in this invention include amines selected from ammonia, butylamine, aminoethylethanolamine, aminopropan-2-ol, 5-aminopentan-1-ol, 2-(2-aminoethoxy) ethanol, monoethanolamine, 3-aminopropan-1-ol, 2-((3-aminopropyl)amino)ethanol, dimethylaminopropylamine, and N-(alkoxyalkyl)-alkanediamines including N-(octyloxyethyl)-1,2-diaminoethane and N-(decyloxypropyl)-N-methyl-1,3-diaminopropane.

Many patents have described useful acylated nitrogen compounds including U.S. Pat. Nos. 3,172,892; 3,219,666; 3,272,746; 3,310,492; 3,341,542; 3,444,170; 3,455,831; 3,455,832; 3,576,743; 3,630,904; 3,632,511; 3,804,763, 4,234,435 and 6,821,307.

A preferred acylated nitrogen compound of this class is that made by reacting a poly(isobutene)-substituted succinic acid-derived acylating agent (e.g., anhydride, acid, ester, etc.) wherein the poly(isobutene) substituent has between about 12 to about 200 carbon atoms and the acylating agent has from 1 to 2, preferably predominantly 1 succinic-derived acylating groups; with a mixture of ethylene polyamines having 3 to about 9 amino nitrogen atoms, preferably about 3 to about 8 nitrogen atoms, per ethylene polyamine and about 1 to about 8 ethylene groups. These acylated nitrogen compounds are formed by the reaction of a molar ratio of acylating agent:amino compound of from 10:1 to 1:10, preferably from 5:1 to 1:5, more preferably from 2.5:1 to 1:2, more preferably from 2:1 to 1:2 and most preferably from 2:1 to 1:1. In especially preferred embodiments, the acylated nitrogen compounds are formed by the reaction of acylating agent to amino compound in a molar ratio of from 1.8:1 to 1:1.2, preferably from 1.6:1 to 1:1.2, more preferably from 1.4:1 to 1:1.1 and most preferably from 1.2:1 to 1:1. This type of acylated amino compound and the preparation thereof is well known to those skilled in the art and are described in the above-referenced US patents. In other especially preferred embodiments, the acylated nitrogen compounds are formed by the reaction of acylating agent to amino compound in a molar ratio of from 2.5:1 to 1.5:1, preferably from 2.2:1 to 1.8:1.

Preferred acylated nitrogen compounds for use herein include: the compound formed by reacting a polyisobutylene succinic anhydride (PIBSA) having a PIB molecular weight of 900 to 1100, for example approximately 1000 with aminoethyl ethanolamine or triethylene tetramine; and the compound formed by reacting a PIBSA having a PIB molecular weight of 650 to 850, for example about 750 with tetraethylene pentamine. In each case the ratio of PIBSA to amine is from 1.5:1 to 0.9:1, preferably from 1.2:1 to 1:1. Other preferred acylated nitrogen compounds for use herein include: the compound formed by reacting a polyisobutylene succinic anhydride (PIBSA) having a PIB molecular weight of 900 to 1100, for example approximately 1000 with tetraethylene pentamine, the ratio of PIBSA to amine being from 2.5:1 to 1.5:1, preferably from 2.2:1 to 1.8:1.

In some embodiments the one or more additional deposit control additives comprises a hydrocarbyl substituted amine.

Hydrocarbyl-substituted amines suitable for use in the present invention are well known to those skilled in the art and are described in a number of patents. Among these are U.S. Pat. Nos. 3,275,554; 3,438,757; 3,454,555; 3,565,804; 3,755,433 and 3,822,209. These patents describe suitable hydrocarbyl amines for use in the present invention including their method of preparation.

Preferred hydrocarbyl substituted amines are polyisobutene amines. Such compounds can be prepared by the hydroformylation of polyisobutene (especially high reactive polyisobutene), followed by reductive amination.

Examples of suitable compounds are described in EP244616 (see especially example 1) and US20070094922 (see especially example 2).

In some embodiments the one or more additional deposit control additives comprises a Mannich reaction product.

The Mannich additives comprise nitrogen-containing condensates of a phenol, aldehyde and primary or secondary amine.

The amine used to form the Mannich Additive (v) can be a monoamine or a polyamine.

Examples of monoamines include but are not limited to ethylamine, dimethylamine, diethylamine, n-butylamine, dibutylamine, allylamine, isobutylamine, cocoamine, stearylamine, laurylamine, methyllaurylamine, oleylamine, N-methyl-octylamine, dodecylamine, diethanolamine, morpholine, and octadecylamine.

Suitable polyamines may be selected from any compound including two or more amine groups. Suitable polyamines include polyalkylene polyamines, for example in which the alkylene component has 1 to 6, preferably 1 to 4, most preferably 2 to 3 carbon atoms. Preferred polyamines are polyethylene polyamines.

The polyamine has 2 to 15 nitrogen atoms, preferably 2 to 10 nitrogen atoms, more preferably 2 to 8 nitrogen atoms. In especially preferred embodiments the amine used to form the Mannich detergent comprises a diamine.

Polyamines may be selected from any compound including two or more amine groups. Preferably the polyamine is a (poly)alkylene polyamine (by which is meant an alkylene polyamine or a polyalkylene polyamine; including in each case a diamine, within the meaning of "polyamine"). Preferably the polyamine is a (poly)alkylene polyamine in which the alkylene component has 1 to 6, preferably 1 to 4, most preferably 2 to 3 carbon atoms. Most preferably the polyamine is a (poly)ethylene polyamine (that is, an ethylene polyamine or a polyethylene polyamine).

Preferably the polyamine has 2 to 15 nitrogen atoms, preferably 2 to 10 nitrogen atoms, more preferably 2 to 8 nitrogen atoms.

The polyamine may, for example, be selected from ethylenediamine, dimethyl amino propylamine, diethylenetriamine, triethylenetetramine, tetraethylenepentamine, pentaethylene-hexamine, hexaethyleneheptamine, heptaethyleneoctamine, propane-1,2-diamine, 2 (2-aminoethylamino)ethanol, and N',N'-bis(2-aminoethyl) ethylenediamine ($N(CH_2CH_2NH_2)_3$). In some embodiments the polyamine comprises tetraethylenepentamine or ethylenediamine. Preferred mannich additives of this type are described in U.S. Pat. No. 5,876,468.

Commercially available sources of polyamines typically contain mixtures of isomers and/or oligomers, and products prepared from these commercially available mixtures fall within the scope of the present invention.

In some preferred embodiments, the primary or secondary amine has only one reactive primary or secondary amine group. Such amines include the monoamines as described above, particularly secondary monoamines and polyamines having only one reactive primary or secondary amine group such as dialkyl alkylene diamines. Preferred Mannich additives of this type are described in U.S. Pat. Nos. 5,725,612, 5,634,951 and 6,800,103.

Suitable Mannich reaction products for use herein are described, for example in EP1250404, EP870819, EP1226188, EP1229100 and U.S. Pat. No. 10,457,884.

Suitable phenols that may be used in forming the Mannich reaction products include polypropylphenol, polybutylphenols and polybutyl-copolypropylphenols. Other similar long-chain alkylphenols may also be used.

Preferred phenols are polybutylphenols, especially those prepared from high reactivity polyisobutenes.

The long chain alkyl substituents on the benzene ring of the phenolic compound are derived from polyolefins having a number average molecular weight (Mn) of from about 500 to about 3000, preferably from about 500 to about 2100, as determined by gel permeation chromatography (GPC). It is also preferred that the polyolefin used have a polydispersity (weight average molecular weight/number average molecular weight) in the range of about 1 to about 4 (preferably from about 1 to about 2) as determined by GPC.

The Mannich reaction product additive may be made from a long chain alkylphenol. However, other phenolic compounds may be used including high molecular weight alkyl-substituted derivatives of cresol, resorcinol, hydroquinone, catechol, hydroxydiphenyl, benzylphenol, phenethylphenol, naphthol, tolylnaphthol, among others. Preferred for the preparation of the Mannich reaction product additive are the polyalkylphenol and polyalkylcresol reactants, e. g., polypropylphenol, polybutylphenol, polypropylcresol and polybutylcresol, wherein the alkyl group has a number average molecular weight of about 500 to about 2100, while the most preferred alkyl group is a polybutyl group derived from polyisobutylene having a number average molecular weight in the range of about 800 to about 1300.

The preferred configuration of the alkyl-substituted hydroxyaromatic compound is that of a para-substituted mono-alkylphenol or a para-substituted monoalkyl orthocresol. However, any alkylphenol readily reactive in the Mannich condensation reaction may be employed. Thus, Mannich reaction products made from alkylphenols having only one ring alkyl substituent, or two or more ring alkyl substituents are suitable for use in the present invention. The long chain alkyl substituents may contain some residual unsaturation, but in general, are substantially saturated alkyl groups.

Suitable amines useful for preparing the Mannich reaction products include alkylene polyamines having at least one suitably reactive primary or secondary amino group in the molecule. Other substituents such as hydroxyl, cyano, amido, etc., can be present in the polyamine. Preferably the alkylene polyamine is a polyethylene polyamine. Suitable alkylene polyamine reactants include ethylenediamine, diethylenetriamine, triethylenetetramine, tetraethylenepentamine, and mixtures of such amines having nitrogen contents corresponding to alkylene polyamines of the formula H2N-(A-NH—)"H, where A is divalent ethylene or propylene and n is an integer of from 1 to 10, preferably 1 to 4. The alkylene polyamines may be obtained by the reaction of ammonia and dihalo alkanes, such as dichloro alkanes.

In another preferred embodiment of the present invention, the amine is an aliphatic diamine having one primary or secondary amino group and at least one tertiary amino group in the molecule. Examples of suitable polyamines include N,N,N",N"'-tetraalkyldialkylenetriamines (two terminal tertiary amino groups and one central secondary amino group), N,N,N',N"-tetraalkyltrialkylenetetramines (one terminal tertiary amino group, two internal tertiary amino groups and one terminal primary amino group), N,N,N', N",N"'-pentaalkyltrialkylenetetramines (one terminal tertiary amino group, two internal tertiary amino groups and one terminal secondary amino group), N, N-dihydroxyalkyl-alpha, omega-alkylenediamines (one terminal tertiary amino group and one terminal primary amino group), N,N,N'-trihydroxyalkyl-alpha, omega-alkylenediamines (one terminal tertiary amino group and one terminal secondary amino group), tris(dialkylaminoalkyl) aminoalkylmethanes (three terminal tertiary amino groups and one terminal primary amino group), and similar compounds, wherein the alkyl groups are the same or different and typically contain no more than about 12 carbon atoms each, and which preferably contain from 1 to 4 carbon atoms each. Most preferably these alkyl groups are methyl and/or ethyl groups. Preferred polyamine reactants are N,N-dialkyl-alpha, omegaalkylenediamine, such as those having from 3 to about 6 carbon atoms in the alkylene group and from 1 to about 12 carbon atoms in each of the alkyl groups, which most preferably are the same but which can be different. Most preferred is N. N-dimethyl1,3-propanediamine and N-methyl piperazine.

Examples of polyamines having one reactive primary or secondary amino group that can participate in the Mannich condensation reaction, and at least one sterically hindered amino group that cannot participate directly in the Mannich condensation reaction to any appreciable extent include N-(tert-butyl)-1, 3propanediamine, N-neopentyl-1,3-propanediamine, N-(tert-butyl)-1-methyl-1,2ethanediamine, N-(tert-butyl)-1-methyl-1,3-propanediamine, and 3,5-di (tertbutyl) aminoethylpiperazine.

Suitable aldehydes for use in the preparation of the Mannich reaction products include aliphatic aldehydes such as formaldehyde, acetaldehyde, propionaldehyde, butyraldehyde, valeraldehyde, caproaldehyde, heptaldehyde and stearaldehyde; and aromatic aldehydes including benzaldehyde and salicylaldehyde. Also useful are formaldehyde-producing reagents such as paraformaldehyde, or aqueous formaldehyde solutions such as formalin. Most preferred is formaldehyde or formalin.

Preferred Mannich reaction products for use herein are prepared by the reaction of a polyisobutenyl substituted phenol or cresol, formaldehyde and an amine selected from polyethylene polyamines, dimethylaminopropylamine and dialkylamines (for example dimethylamine or dibutylamine). The polyisobutenyl substituent preferably has a number average molecular weight of from 500 to 3000, preferably from 500 to 2100, more preferably from 750 to 1300.

The present invention relates to uses of a gasoline fuel composition.

By the term "gasoline", it is meant a liquid fuel for use with spark ignition engines (typically or preferably containing primarily or only C4-C12 hydrocarbons) and satisfying international gasoline specifications, such as ASTM D-439 and EN228. The term includes blends of distillate hydrocarbon fuels with oxygenated components such as alcohols or ethers for example methanol, ethanol, butanol, methyl t-butyl ether (MTBE), ethyl t-butyl ether (ETBE), as well as the distillate fuels themselves.

The gasoline fuel compositions used in the present invention may contain one or more further additives conventionally added to gasoline, for example other detergents, dispersants, anti-oxidants, anti-icing agents, metal deactivators, lubricity additives, friction modifiers, dehazers, corrosion inhibitors, dyes, markers, octane improvers, anti-valve-seat recession additives, stabilisers, demulsifiers, antifoams, odour masks, conductivity improvers and combustion improvers.

In some preferred embodiments the gasoline compositions used in the present invention comprise a friction modifier.

Suitable Friction Modifiers Include:

- salts of a branched fatty acid and an n-alkylamine, for example n-butylammonium isostearate. Compounds of this type are described, for example in U.S. Pat. No. 6,866,690;
- esters formed from the partial esterification of polyols by reaction with unsaturated fatty acids, for example glyceryl monooleate. Compounds of this type are described in U.S. Pat. No. 4,617,026;

the reaction product of an alkanolamine and a fatty acid or natural oil. Fatty acid amides of this type include the reaction product of diethanolamine and coconut oil and the reaction product of isostearic acid and diethanolamine. Such compounds are described, for example in WO2001072930 and U.S. Pat. No. 8,444,720.

Suitable treat rates of the quaternary ammonium salt additive and, when present, the one or more deposit control additives may depend on the type of fuel used and different levels of additive may be needed to achieve different levels of performance.

Suitably the quaternary ammonium salt additive is present in the gasoline fuel composition in an amount of from 0.01 to 10000 ppm, preferably from 0.1 to 1000 ppm, preferably from 0.5 to 500 ppm, for example 1 to 250 ppm or 1 to 100 ppm.

Suitably the one or more additional deposit control additives, when present, are present in the gasoline fuel composition in an amount of from 0.01 to 10000 ppm, preferably from 0.1 to 1000 ppm, preferably from 0.5 to 500 ppm. Preferably from 1 to 250 ppm, for example 1 to 100 ppm.

In this specification ppm refers to parts per million by weight.

Each of the quaternary ammonium salt additive and the one or more additional deposit control additives when present may be provided as a mixture of compounds. The above amounts refer to the total of all such compounds present in the composition.

For the avoidance of doubt the above amounts refer to the amount of active additive compound present in the composition and ignore any impurities, solvents or diluents which may be present.

In some embodiments the gasoline fuel composition comprises from 0.01 to 10000 ppm, preferably from 0.1 to 1000 ppm, preferably from 0.5 to 250 ppm. for example 1 to 100 ppm of a quaternary ammonium salt additive and from 0.01 to 10000 ppm, preferably from 0.5 to 1000 ppm, preferably from 1 to 250 ppm, for example 1 to 100 ppm, of the product of a Mannich reaction between an aldehyde, an amine and an optionally substituted phenol.

In some embodiments the gasoline fuel composition comprises from 0.01 to 10000 ppm, preferably from 0.5 to 1000 ppm, preferably from 1 to 250 ppm, for example 1 to 100 ppm of a quaternary ammonium salt additive and from 0.01 to 10000 ppm, preferably from 0.5 to 1000 ppm, preferably from 1 to 250 ppm, for example 1 to 100 ppm of a hydrocarbyl substituted amine.

A particular advantage of the present invention is that the quaternary ammonium compounds, optionally in combination with an additional deposit control additive can provide effective removal of deposits even at very low treat rates.

In some preferred embodiments the gasoline fuel composition comprises less than 50 ppm of the quaternary ammonium salt additive, preferably less than 40 ppm, more preferably less than 30 ppm, suitably less than 25 ppm.

In some embodiments the gasoline fuel composition comprises less than 20 ppm of the quaternary ammonium salt additive, for example less than 15 ppm, less than 12 ppm or less than 10 ppm.

In some embodiments the gasoline fuel compositions comprises from 0.1 to 50 ppm, preferably 0.5 to 25 ppm, more preferably 0.5 to 10 ppm, for example 1 to 8 ppm of the quaternary ammonium salt additive.

In some embodiments the gasoline fuel composition comprises from 0.01 to 50 ppm, preferably from 0.1 to 30 ppm, preferably from 1 to 20 ppm, for example 1 to 10 ppm of a quaternary ammonium salt additive, and optionally from 0.1 to 10000 ppm, preferably from 1 to 1000 ppm, preferably from 5 to 500 ppm, for example 5 to 250 ppm of one or more of:

the product of a Mannich reaction between an aldehyde, an amine and an optionally substituted phenol; and a hydrocarbyl substituted amine.

The present invention provides a method and use for removing deposits in a direct injection spark ignition engine. The removal of deposits may be regarded as providing "clean-up" of the engine.

"Clean-up" of a fouled engine may provide significant advantages. For example, superior clean up may lead to an increase in power and/or an increase in fuel economy and/or a reduction in pollutant emissions. In addition removal of deposits from an engine, in particular from injectors may lead to an increase in interval time before injector maintenance or replacement is necessary thus reducing maintenance costs.

In some preferred embodiments, clean up may also provide a power increase.

The removal of deposits according to the present invention will lead to an improvement in performance of the engine.

The improvement in performance of the gasoline engine system may be measured by a number of ways.

Suitably the method and use of the present invention provides in a direct injection spark ignition engine one or more of:

improved fuel economy
reduced maintenance
less frequent overhaul or replacement of injectors
improved driveability
improved power
improved acceleration.

"Clean up" performance can be observed by an improvement in performance of an already fouled engine.

The effectiveness of fuel additives is often assessed using a controlled engine test.

One suitable test assessing the performance of direct injection spark ignition engines is described in example 12.

To measure the clean up performance of an additive, an engine test typically involves a first phase in which unadditised fuel is combusted in an engine. This leads to deposit formation and is regarded as the "dirty up" phase. The fuel is then switched to an additised fuel and the effectiveness of this fuel at cleaning up the engine in the "clean-up" phase is assessed.

In a controlled direct injection spark ignition engine test, engine speed and load is held within a tight tolerance.

In order to do this the engine control unit adjusts the injection time (or pulse width) to maintain engine performance. In a fouled engine, injection time is increased. Clean up performance of an additised fuel composition can be assessed by measuring the time taken for the injection time to return to the initial injection time when using clean injectors.

For the avoidance of doubt, in the context of the direct injection spark ignition engine, by the term "injection time" we mean to refer to the duration of the injection of fuel into the combustion chamber.

Preferably the method and the use of the present invention restore the injection time of a fouled engine to within 10% of the initial injection time when using clean injectors in a period of less than 10 hours, preferably less than 8 hours, for example less than 6 hours.

The invention will now be further defined with reference to the following non-limiting examples.

Raw Materials

The polyisobutylene used in the synthesis examples was purchased under the trade mark HRPB1000 (Daelim, South Korea) and had a number average molecular weight ($M_n$) of approximately 1,000 and a terminal vinylidene content ≥80% ($^{13}C$ NMR).

Analytical Methods

The acid value of PIBSA was determined by non-aqueous titration against lithium methoxide solution (ca 0.1 M in toluene/methanol) using thymol blue (0.4% w/v in 1,4-dioxane) as the indicator. The titre of lithium methoxide solutions was regularly confirmed by titration against analytical grade benzoic acid.

The residual maleic anhydride content of polyisobutylenesuccinic anhydride (PIBSA) was measured by quantitative FTIR against a calibration curve. The characteristic absorbance at 696 $cm^{-1}$ was used for the analysis.

The residual (unreacted) polyisobutylene content of polyisobutylenesuccinic anhydride (PIBSA) was measured by quantitative HPLC against a polyisobutylene standard, under normal phase column conditions (eluent:isohexane).

The 'P value' (average number of succinyl residues per polyisobutylene side chain, in the sample) may be calculated using the following formula:

$$P = \frac{\text{Acid value} \times PIB\ MW}{(20(100 - PIB\ \text{content}) - (\text{Acid Value} * 98.06)}$$

wherein 'PIB MW' is the number average molecular weight (Mn) of the polyisobutenyl substituent and PIB content is the residual (unreacted) polyisobutylene content as described above.

The derivation of this equation is described below.

PIB content is measured as a percentage by weight (g/100 g).

Acid value (AV) is recorded as the number of acid groups (mmol) per gram of sample.

$$x = \text{mmol monomaleated } PIBSA/\text{g}$$

$$y = \text{mmol bismaleated } PIBSA/\text{g}$$

$$x + 2y = 1/2\ AV$$

$$2x + 4y = AV$$

$$x = \frac{(AV - 4y)}{2}$$

$$(MW + 98)x + (MW + 196)y = 10(100 - PIB)\ [\text{units each side mg/g}]$$

$$(MW + 98)(AV - 4y) + 2(MW + 196)y = 20(100 - PIB)$$

$$(MW + 98)AV - 4y(MW + 196) + 2(MW + 196)y = 20(100 - PIB)$$

$$(MW + 98)AV - 20(100 - PIB) = 4y(MW + 98) - 2(MW + 196)y =$$

$$4yMW + 392y - 2yMW - 392y$$

$$y = \frac{(MW + 98)AV - 20(100 - PIB)}{2MW}$$

$$P = \frac{x + 2y}{x + y} = \frac{x + 2y}{(x + 2y) - y} = \frac{1/2\ AV}{1/2\ AV - \frac{(MW + 98)AV - 20(100 - PIB)}{2MW}}$$

$$P = \frac{AV}{AV - \left(\frac{AV(mw + 98) - 20(100 - PIB}{mw}\right)}$$

-continued $$P = \frac{AV \cdot mw}{AV \cdot mw - AV \cdot mw - AV \cdot 98 + 20(100 - PIB)}$$

$$P = \frac{AV \cdot mw}{20(100 - PIB) - (AV \cdot 98)}$$

EXAMPLE 1—PREPARATION OF POLYISOBUTYLENESUCCINIC ANHYDRIDE (PIBSA)—INVENTIVE 700 g (0.7 mol) of polyisobutylene ($M_n$ 1000) was charged to a nitrogen flushed, jacketed reactor fitted with an overhead stirrer. The starting material was heated to 120° C. with stirring and nitrogen inerting was repeated. The reaction temperature was increased to 190° C. and maleic anhydride (82.4 g, 0.84 mol, 1.2 eq) was charged over 1 hour. After maintaining a temperature of 190° C. for a further 1 hour, the temperature was increased to 200-208° C. and held in this range for 8 hours. Vacuum (<30 mbar) was then applied for 2.5 hrs, whilst maintaining the reaction temperature, which reduced the level of residual maleic anhydride to ≤0.05 wt %. The reaction mass was cooled to ≤80° C. then discharged from the reactor.

EXAMPLE 2—PREPARATION OF PIBSA—COMPARATIVE

The synthesis procedure was substantially identical to Example 1 and used the same grade of polyisobutylene ($M_n$ 1000). The charge of maleic anhydride was reduced (1 eq relative to polyisobutylene) and the reaction was held between 190-210° C. during the 8 hour heating period. Residual maleic anhydride was also measured as ≤0.05 wt %.

The properties of the reaction products of Examples 1 and 2 are summarised in Table 1.

TABLE 1

| Example | Acid value (mmolH+/g) | Unreacted PIB (wt %) | Molecular weight of PIB starting material (Mn) | P value |
|---|---|---|---|---|
| 1 | 1.89 | 18.5 | 1000 | 1.31 |
| 2 | 1.68 | 20.2 | 1000 | 1.17 |

EXAMPLE 3—ADDITIVE Q1—INVENTIVE

PIBSA prepared according to Example 1 was charged to a nitrogen flushed, jacketed reactor fitted with an overhead stirrer and heated to 120° C. 3-(dimethylamino)propylamine (DMAPA) (1 eq relative to anhydride groups) was charged slowly, maintaining the reaction temperature between 120-130° C. After stirring at 120° C. for a further 1 hr, the reaction temperature was increased to 140° C. and held for 3 hrs with concurrent distillation of water. Methyl salicylate (2.1 eq relative to anhydride groups) was added in a single portion and heating was continued at 140° C. for 10 hours. The reaction mass was diluted with Aromatic 150 solvent to provide an overall solids content of 60 wt % prior to discharging from the reactor.

EXAMPLE 4—ADDITIVE Q2—COMPARATIVE

PIBSA prepared according to Example 2 was charged to a nitrogen flushed, jacketed reactor fitted with an overhead stirrer and heated to 90° C. 3-(dimethylamino)propylamine (DMAPA) (1 eq relative to anhydride groups) was charged slowly, maintaining the reaction temperature between 90-100° C. After stirring at 90-100° C. for a further 1 hr, the reaction temperature was increased to 140° C. and held for 4 hrs with concurrent distillation of water. 2-ethylhexanol was added to adjust the solids content to 60 wt % then methyl salicylate (1 eq relative to anhydride groups) was added in a single portion and heating was continued at 140° C. for 15 hours. The reaction mass was cooled to 60° C. prior to discharging from the reactor.

EXAMPLE 5—PREPARATION OF DMAPA POLYISOBUTYLENE SUCCINIMIDE PROPYLENE OXIDE/ACETIC ACID QUATERNARY AMMONIUM SALT—INVENTIVE

PIBSA according to Example 1 was charged to a nitrogen flushed, jacketed reactor fitted with an overhead stirrer and heated to 120° C. 3-(dimethylamino)propylamine (DMAPA) (1 eq relative to anhydride groups) was charged slowly, maintaining the reaction temperature between 120-130° C. After stirring at 120° C. for a further 1 hr, the reaction temperature was increased to 140° C. and held for 3 hrs with concurrent distillation of water. The reaction mass was cooled to room temperature, then acetic acid (0.71 eq relative to anhydride groups), 2-ethylhexanol (1.34 eq relative to anhydride groups) and water (0.81 eq relative to anhydride groups) were added. The reaction mass was heated to 75° C. and propylene oxide (2.39 eq relative to anhydride groups) was added over 3 hrs via a dropping funnel. Heating was continued for 4 hrs. The reaction mass was diluted with Aromatic 150 solvent to provide an overall solids content of 60 wt % prior to discharging from the reactor.

EXAMPLE 6—PREPARATION OF DMAPA POLYISOBUTYLENE SUCCINIMIDE PROPYLENE OXIDE/ACETIC ACID QUATERNARY AMMONIUM SALT—COMPARATIVE

PIBSA according to Example 2 was used. Formation of the DMAPA succinimide and subsequent quaternization using propylene oxide/AcOH was carried out in identical manner to Example 5. Reactant charges were calculated relative to anhydride groups in the PIBSA starting material.

EXAMPLE 7—PREPARATION OF DMAPA POLYISOBUTYLENE SUCCINAMIDE PROPYLENE OXIDE QUATERNARY AMMONIUM SALT—INVENTIVE

PIBSA according to Example 1 (1 part) and Caromax 20 (1 part) were charged to a nitrogen flushed, jacketed reactor fitted with an overhead stirrer and heated to 80° C. to ensure proper mixing, then cooled to room temperature. 3-(dimethylamino)propylamine (DMAPA) (1 eq relative to anhydride groups in the PIBSA starting material) was added over 3 hrs, maintaining the reaction temperature below 40° C. The reaction mass was stirred for a further 4 hrs, then propylene oxide (2 eq relative to anhydride groups) was added over 3 hrs, then the reaction mass stirred at room temperature for 4 hrs. After nitrogen sparging to remove residual propylene oxide, the reaction mass was discharged from the reactor.

EXAMPLE 8—PREPARATION OF DMAPA POLYISOBUTYLENE SUCCINAMIDE PROPYLENE OXIDE QUATERNARY AMMONIUM SALT—COMPARATIVE

PIBSA according to Example 2 was used. Formation of the DMAPA succinamide and subsequent quaternization using propylene oxide was carried out in identical manner to Example 7. Reactant charges were calculated relative to anhydride groups.

EXAMPLE 9—ADDITIVE A1

Additive A1, a Mannich reaction product additive of the prior art was prepared as follows:

A 1 L reactor was charged with dodecylphenol (170.6 g, 0.65 mol), ethylenediamine (30.1 g, 0.5 and Caromax 20 (123.9 g). The mixture was heated to 95° C. and formaldehyde solution, 37 wt % (73.8 g, 0.9 mol) charged over 1 hour. The temperature was increased to 125° C. for 3 hours and water removed. In this example the molar ratio of aldehyde (a): amine (b): phenol (c) was approximately 1.8:1:1.3.

EXAMPLE 10—ADDITIVE A2

Additive A2 is a 60 wt % active ingredient solution (in aromatic solvent) of a polyisobutenyl succinimide obtained from the condensation reaction of a polyisobutenyl succinic anhydride (PIBSA) derived from polyisobutene of Mn approximately 750 with a polyethylene polyamine mixture of average composition approximating to tetraethylene pentamine. The product was obtained by mixing the PIBSA and polyethylene polyamine at 50° C. under nitrogen and heating at 160° C. for 5 hours with removal of water.

| | | | Limits | | |
|---|---|---|---|---|---|
| Feature | Units | Results | Minimum | Maximum | Method |
| RON (*1) | | 96.4 | 98.0 | — | DIN EN ISO 5164: 2014-10 |
| MON (*1) | | 87.3 | 87.0 | — | DIN EN ISO 5163: 2014-10 |
| Density at 15° C. | kg/m3 | 748.8 | 745.0 | 760.0 | ASTM D4052: 2018a |
| DVPE | kPa | 62.4 | 60.0 | 65.0 | DIN EN 13016-1: 2018-06 |
| Appearance | — | clear and bright | — | — | HM-32 (Visual) |
| Distillation IBP | ° C. | 32.1 | 25.0 | 35.0 | DIN EN ISO 3405: 2019-09 |
| Dist. 10% v/v | ° C. | 50.7 | 45.0 | 55.0 | DIN EN ISO 3405: 2019-09 |
| Dist. 50% v/v | ° C. | 102.2 | 95.0 | 110.0 | DIN EN ISO 3405: 2019-09 |
| Dist. 90% v/v | ° C. | 173.0 | 160.0 | 180.0 | DIN EN ISO 3405: 2019-09 |
| Dist. 70degC | %(V/V) | 26.8 | 22.0 | 50.0 | DIN EN ISO 3405: 2019-09 |

-continued

| Feature | Units | Results | Limits Minimum | Maximum | Method |
|---|---|---|---|---|---|
| Dist. 100degC | %(V/V) | 48.4 | 46.0 | 71.0 | DIN EN ISO 3405: 2019-09 |
| Dist. 150degC | %(V/V) | 82.2 | 75.0 | — | DIN EN ISO 3405: 2019-09 |
| Distillation FBF | ° C. | 197.3 | 190.0 | 210.0 | DIN EN ISO 3405: 2019-09 |
| Dist. Residue | %(V/V) | 1.0 | — | 2.0 | DIN EN ISO 3405: 2019-09 |
| Oxidation Stabilit (*1) | min. | >480 | 480 | — | DIN EN ISO 7536: 1996-08 |
| Solvent Washed Gum | mg | <0.5 per 100 mL | — | 4.0 | DIN EN ISO 6246: 2020-01 |
| Aromatics | %(V/V) | 31.9 | | 35.0 | DIN EN ISO 22854: 2016 |
| Olefins | %(V/V) | 13.3 | 10.0 | 14.0 | DIN EN ISO 22854: 2016 |
| Saturates | %(V/V) | 54.7 | | | DIN EN ISO 22854: 2016 |
| Benzene | %(V/V) | 0.22 | — | 1.00 | DIN EN ISO 22854: 2016 |
| Corrosion - Copper | — | 1A max. 1 | — | — | DIN EN ISO 2160: 1999-04 |
| Oxygenates | %(V/V) | <0.20 modified, not accredited | — | 0.20 | DIN EN ISO 22854: 2016 |
| Oxygenates | %(V/V) | <0.80 | | 0.80 | DIN EN ISO 22854: 2016 |
| Hydrogen | % w | 13.23 | | | ASTM D3343: 2016 |
| Carbon | % w | 86.77 | | | ASTM D3343: 2016 |
| C:H Ratio (H = 1) | | 6.56 | | | ASTM D3343: 2016 |
| H:C Ratio (C = 1) | | 0.153 | | | ASTM D3343: 2016 |
| Net Heating Value | MJ/kg | 42.844 | | | ASTM D3338: 2009 |
| Net Heating Value | Btu/lb | 18420 | | | ASTM D3338: 2009 |
| Lead (*1) | mg/l | <2.5 | — | 5.0 | ASTM D3237: 2017 |
| Sulfur | mg/kg | 3.6 | — | 10.0 | DIN EN ISO 20846: 2019-12 |
| Phosphorus (*1) | g/l | <0.0002 | | 0.0013 | ASTM D3231: 2018 |
| Manganese (*1) | mg/l | <0.50 | | 2.00 | DIN EN 16136: 2015-04 |
| Al (*1) | mg/kg | <0.1 | — | 0.1 | ICP-OES |
| B (*1) | mg/kg | <0.1 | — | 0.1 | ICP-OES |
| Ba (*1) | mg/kg | <0.1 | — | 0.1 | ICP-OES |
| Ca (*1) | mg/kg | <0.1 | — | 0.1 | ICP-OES |
| Cr (*1) | mg/kg | <0.1 | — | 0.1 | ICP-OES |
| Cu (*1) | mg/kg | <0.1 | — | 0.1 | ICP-OES |
| Fe (*1) | mg/kg | <0.5 | — | 5.0 | ICP-OES |
| Mg (*1) | mg/kg | <0.1 | — | 0.1 | ICP-OES |
| Mo (*1) | mg/kg | <0.1 | — | 0.1 | ICP-OES |
| Ni (*1) | mg/kg | <0.1 | — | 0.1 | ICP-OES |
| Si (*1) | mg/kg | <0.1 | — | 0.1 | ICP-OES |
| Zn (*1) | mg/kg | <0.1 | — | 0.1 | ICP-OES |

EXAMPLE 11

A gasoline fuel composition was prepared by adding 6 ppm active by weight of additive Q1 to an E0 gasoline fuel according to DIN EN 228 from Haltermann Carless (DISI TF Low Sulphur, Batch II1503T456, Orig. Batch 8). The gasoline fuel had the following specification:

EXAMPLE 12

The fuel prepared in example 11 was tested according to a preliminary version of the upcoming CEC test for injector fouling in DISI engines (TDG-F-113) and was published by D. Weissenberger, J. Pilbeam, "Characterisation of Gasoline Fuels in a DISI Engine", lecture held at Technische Akademie Esslingen, June 2017. The test engine is a VW EA111 1 4L TSI engine with 125 KW. The test procedure is a steady state test at an engine speed of 2000 rpm and a constant torque of 56 Nm. The test procedure is performed with the following injectors: Magneti Marelli 03C 906036 E. Reference oil RL-271 from Haltermann Carless was used as engine oil.

The dirty up phase involved running the engine for 48 hours using unadditised base fuel. Following addition of the additised fuel it took just four hours for the injection time to return to its initial level when using clean injectors.

This test was also carried out on the same base fuel comprising 6 ppm of additive Q2. In that case it took 12 hours for the injection time to return to its initial level when using clean injectors following addition of the additised fuel.

The invention claimed is:

1. A method of removing deposits in a direct injection spark ignition engine, the method comprising combusting in the engine a gasoline fuel composition comprising a quaternary ammonium salt additive wherein the quaternary ammonium salt additive comprises the quaternised reaction product of a hydrocarbyl substituted succinic acid derived acylating agent and a compound able to react with said acylating agent and which includes a tertiary amine group; wherein each molecule of the hydrocarbyl substituted succinic acid derived acylating agent includes on average at least 1.2 succinic acid moieties, and wherein the gasoline composition comprises from 0.1 to 50 pom of the quatemary ammonium salt additive.

2. The method of claim 1, wherein the hydrocarbyl substituted succinic acid derived acylating agent is a polyisobutene-substituted succinic acid or succinic anhydride wherein the polyisobutene substituent has a number average molecular weight of between 450 to 2300.

3. The method of claim 1, wherein the compound able to react with the hydrocarbyl substituted succinic acid derived acylating agent and which includes a tertiary amine group comprises one or more compounds formed by the reaction of a hydrocarbyl-substituted acylating agent and an amine of formula (I) or (II):

(I)

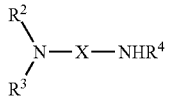

(II)

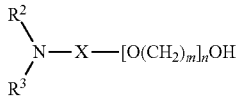

wherein $R^2$ and $R^3$ are the same or different alkyl, alkenyl, aryl, alkaryl or aralkyl groups having from 1 to 22 carbon atoms; X is an optionally substituted alkylene group having from 1 to 20 carbon atoms; n is from 0 to 20; m is from 1 to 5; and $R^4$ is hydrogen or a $C_1$ to $C_{22}$ alkyl group.

4. The method of claim 3, wherein X is a propylene group.

5. The method of claim 1, wherein the quatemary ammonium salt additive is formed by reacting a quatemsing agent with the reaction product of a hydrocarbyl substituted succinic acid derived acylating agent and a compound able to react with said acylating agent and which includes a tertiary amine group; wherein the quaternising agent used to prepare the quaternary ammonium salt additive is selected from the group consisting of an ester of a carboxylic acid, dialkyl sulfates, benzyl halides, hydrocarbyl substituted carbonates, hydrocarbyl substituted epoxides optionally in combination with an acid, alkyl halides, alkyl sulfonates, sultones, hydrocarbyl substituted phosphates, hydrocarbyl substituted borates, alkyl nitrites, alkyl nitrates, hydroxides, N-oxides, chloroacetic acid or salts thereof, or mixtures thereof.

6. The method of claim 1, wherein the quatemary ammonium salt additive is formed by reacting a quatemsing agent with the reaction product of a hydrocarbyl substituted succinic acid derived acylating agent and a compound able to react with said acylating agent and which includes a tertiary amine group; wherein the quaternising agent used to prepare the quaternary ammonium salt additive is selected from the group consisting of dialkyl sulfates, benzyl halides, hydrocarbyl substituted carbonates, hydrocarbyl substituted epoxides in combination with an acid, alkyl halides, alkyl sulfonates, sultones, hydrocarbyl substituted phosphates, hydrocarbyl substituted borates, N-oxides, chloroacetic acid or salts thereof, or mixtures thereof.

7. The method of claim 1, wherein the quatemary ammonium salt additive is formed by reacting a quatemsing agent with the reaction product of a hydrocarbyl substituted succinic acid derived acylating agent and a compound able to react with said acylating agent and which includes a tertiary amine group; wherein the quaternising agent used to prepare the quaternary ammonium salt additive is a compound of formula (III):

(III)

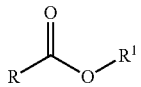

wherein R is an optionally substituted alkyl, alkenyl, aryl or alkylaryl group and $R^1$ is a $C_1$ to $C_{22}$ alkyl, aryl or alkylaryl group.

8. The method of claim 7, wherein the quaternizing agent is selected from dimethyl oxalate, methyl 2-nitrobenzoate and methyl salicylate.

9. The method of claim 7, wherein the quaternizing agent is an ester of a polycarboxylic acid.

10. The method of claim 1, wherein the gasoline fuel composition comprises one or more additional deposit control additives.

11. The method of claim 10, wherein the one or more additional deposit control additives comprises the product of a Mannich reaction between an aldehyde, an amine and an optionally substituted phenol.

12. The method of claim 11, wherein the one or more additional deposit control additives comprises the product of a Mannich reaction between:

(x) formaldehyde;

(y) an amine selected from polyethylene polyamines, dimethylaminopropylamine and dialkylamines; and (z) a polyisobutenyl-substituted phenol or cresol having a polyisobutenyl substituent number average molecular weight of from 500 to 3000.

13. The method of claim 10, wherein the one or more additional deposit control additives comprises a hydrocarbyl substituted amine.

14. The method of claim 1, wherein the gasoline fuel composition comprises a friction modifier compound.

15. The method of claim 1, wherein the gasoline fuel composition comprises 0.5 to 25 ppm of the quaternary ammonium salt additive.

16. The method of claim 1, which restores the injection time to within 10% of the initial injection time when using clean injectors within 10 hours.

* * * * *